US005102157A

United States Patent [19]

Goud et al.

[11] Patent Number: 5,102,157

[45] Date of Patent: Apr. 7, 1992

[54] SAFETY SKI BINDING

[75] Inventors: Gilles R. Goud, Cran Gevrier; Christian Challande, Cruseilles, both of France

[73] Assignee: Salomon S.A., Annecy Cedex, France

[21] Appl. No.: 627,031

[22] Filed: Dec. 13, 1990

[30] Foreign Application Priority Data

Dec. 13, 1989 [FR] France ..... 89 16492

[51] Int. Cl.[5] ..... A63C 9/10

[52] U.S. Cl. ..... 280/625; 280/634

[58] Field of Search ..... 280/625, 633, 634

[56] References Cited

U.S. PATENT DOCUMENTS 3,806,143 4/1974 Wyss ..... 280/625

3,910,592 10/1975 Sittmann ..... 280/625

*Primary Examiner*—David M. Mitchell

*Attorney, Agent, or Firm*—Sandler, Greenblum, & Bernstein

[57] ABSTRACT

A safety binding for a ski adapted to maintain the front of a boot mounted on the ski. Each journal axis of a wing which pivots with respect to the body is engaged in at least one oblong hole for allowing relative displacement over a short distance of the wing with respect to the journal axis and it is in contact under the effect of an energy generating mechanism against a first end of the oblong hole. In the rest position, the wing rests, through its front edge, against a fixed support line of the body situated, in projection, in a vertical and transverse plane, between the journal axis of the wing and the end portion of the front arm in contact with the energy generating mechanism.

9 Claims, 4 Drawing Sheets

SAFETY SKI BINDING

BACKGROUND OF THE INVENTION

1. Field of the Invention

The present invention relates to a safety binding for a ski adapted to maintain the front of a boot mounted on a ski.

2. Description of Background and Relevant Information

Safety bindings of this type, also known as "Front Abutments", generally comprise a body containing an energy generating mechanism acting on a retention jaw mounted on the rear portion of the body of the front abutment. In certain front abutments, the jaw is constituted by two independent lateral retention wings, journalled respectively on the body, around independent axes, and which are positioned symmetrically with respect to the vertical and longitudinal plane of symmetry of the front abutment. The lateral retention wings are biased elastically, by the energy generating mechanism contained in the body, in the direction of the plane of symmetry of the front abutment in a manner so as to squeeze the front of the boot between them. Such front abutments are described, for example in French Patent No. 2,210,422 and Swiss Patent No. 509,810.

During the mounting of a boot on the ski provided with such a front abutment and a rear heel binding maintaining the rear end of the boot, the sole of the boot which is engaged longitudinally towards the front between the two lateral retention wings of the front abutment, pushes these two wings towards the exterior. In the course of this movement the edge of the sole first comes into point contact, on each side, with a lateral roller which is rotationally mounted on the corresponding wing around a vertical axis and which projects with respect to the internal surface of this wing. This roller can if desired be replaced by a projection or bump formed on the internal surface of the wing. With such a construction, as soon as the lateral retention wing tends to move away from its rest position or is in the release position, in which it is relatively close to the vertical and longitudinal plane of symmetry of the front abutment, it exerts, on the edge of the sole which forces it to pivot towards the exterior, a substantial reaction force towards the rear produced by the energy generating mechanism positioned in the body of the binding. The direction of application of this reaction force is thus slightly inclined with respect to the longitudinal axis of the ski and this reaction force is almost totally in opposition to the force exerted towards the front, on the body of the heel binding, the return spring being housed therein. As a consequence, during mounting of the boot, the boot barely opens the front of the lateral retention wings, which are then strongly squeezed by the energy generating mechanism of the front abutment, and on the contrary the positioning and the immobilization of the boot, in the engaged position, occurs only at the expense of a slight retraction of the body of the heel binding against the action of the return spring, which causes a lowering of the release force.

SUMMARY OF THE INVENTION

The present invention attempts to overcome this disadvantage by providing a safety binding for a ski which, by virtue of a special assembly of the lateral retention wings, makes it possible to considerably reduce, during a first, relatively short boot mounting phase from the opening movement of the wings, the reaction force produced by the energy generator mechanism. This makes it possible to obtain a correct engagement of the front of the boot in the front abutment whatever its width and whatever the adjustment setting of the binding without influencing the behavior of the heel binding.

To this end, the safety binding of the invention, which is adapted to maintain the front of a boot mounted on the ski, comprises a body containing an energy generating mechanism acting on a retention jaw which is constituted by two independent lateral retention wings, journalled respectively on the body, around independent vertical axes, and which are positioned symmetrically with respect to the vertical and longitudinal plane of symmetry of the binding, these lateral retention wings being elastically biased by the energy generating mechanism contained in the body, in the direction of the plane of symmetry of the binding, each lateral retention wing, of a general L shape, comprising, at the rear of its journal, a rear arm extending towards the exterior and towards the rear of the ski and adapted to be in contact with the edge of the sole of the boot, and, in front of its journal axis, a short front arm extending substantially transversely in the direction of the plane of symmetry of the front abutment. The energy generating mechanism exerts a force towards the front on the end portion of the front arm of the wing, each wing having a rest position, in the absence of the boot and an operating position after engagement of the boot, in which its rear arm is opened towards the exterior. The binding is characterized by the fact that each journal axis of a wing with respect to the body is engaged in at least one oblong hole allowing for a relative displacement, over a short distance, of the wing with respect to the journal axis and it is in contact, under the effect of the energy generating mechanism against a first end of the oblong hole. In the rest position, the wing rests through its front edge against a fixed support line of the body situated in projection in a vertical and transverse plane between the journal axis of the wing and the end portion of the front arm in contact with the energy generating mechanism, and the wing pivots around this support line during at least one portion of its passage movement from the rest position to the work position, until the journal axis of the wing with respect to the body abuts against the second end of the oblong hole in which it is engaged.

The safety binding according to the invention offers the advantage that during mounting of the boot the front of the sole of the boot first encounters a small resistance from the lateral retention wings which open easily in a manner so as to adapt themselves automatically to the width of the sole. In effect during this phase of mounting, the wings pivot around the fixed support line constituting a temporary pivot axis of the wing, and the ratio of the lever arms is such that the reaction force exerted by the wing on the edge of the sole is small. This phase of mounting at a low wing reaction force is made possible by virtue of the fact that the lateral retention wing can displace itself easily along a short predetermined distance by virtue of the play between this axis and the first end of the one or more oblong holes in which it is engaged. At the end of this mounting phase it is the journal axis of the wing which is in contact with the second end of the one or more oblong holes, which constitute the pivot axis of the wing for a safety release.

In this position the ratio of the lever arm is modified such that the wing exerts on the edge of the sole a much more intense retention force.

BRIEF DESCRIPTION OF THE DRAWING

The invention will now be described with reference to certain non-limiting exemplary embodiments illustrated in the annexed drawings, in which.

DESCRIPTION OF PREFERRED EMBODIMENTS

Figure 1:
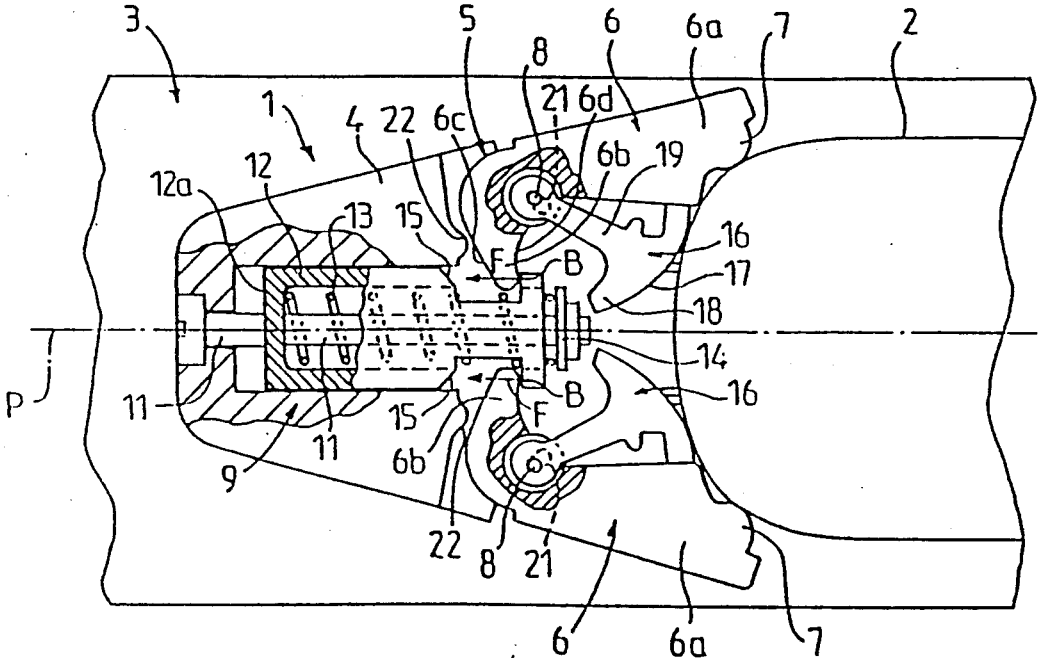
FIG. 1 is a schematic horizontal cross-sectional view of a front abutment according to the invention, in which the wings are in the work position after engagement with a boot in the front abutment.

The safety binding for a ski shown in FIGS. 1–4 constitutes a front abutment 1 which is adapted to maintain the front end of a boot 2 on a ski 3. Front abutment 1 comprises a body 4 affixed to the ski and carries, at its rear portion, a front retention jaw 5 of the front of boot 2. Jaw is constituted by two lateral retention wings 6 which are positioned symmetrically with respect to the vertical and longitudinal planes of symmetry P of the front abutment 1. Each lateral retention wing 6 has a substantially L-shape and comprises a rear arm 6*a* extending towards the exterior of the ski and towards the rear end which carries, at it rear end, a lateral projection 7, of a small diameter, in contact with e sole of boot 2. This projection 7 can be, in fact, constituted by a roller rotatably mounted on arm 6*a* around a vertical axis, and projecting with respect to the external surface of this arm. Each lateral retention wing 6 is journalled, on the body 4, around a vertical axis 8, positioned substantially at the angle of the L which is formed by wing 6, and it comprises, in front of this axis, a short front arm 6*b* extending substantially transversely in the direction of the plane of symmetry P of the front abutment and which comprises front edge 6*c* and rear edge 6*d*.

Front abutment comprises furthermore an energy generating mechanism 9 which is positioned in body 4. This energy generating mechanism 9 is of any appropriate type and in the embodiment described by way of non-limiting example, comprises a longitudinal tie rod 11 affixed to body 4 of front abutment 1 and on which is slidably mounted a force transmission element 12 constituted by a tubular piston axially traversed by tie rod 11. Compression spring 13 is positioned within tubular piston 12 and spring 13 is supported at its front end on the front end 12*a* of tubular piston 13, and, at its rear end, on an abutment 14 provided at the rear end of tie rod 11. This abutment can be constituted, as is shown in the drawings, by a dowel maintained by a blocking screw. As a result, tubular piston 12 is constantly biased towards the front by spring 13. Piston 12 has, at the rear portion of its lateral surface, two openings 15, which are diametrically opposed in the horizontal direction, in which are respectively engaged the ends of the short front transverse arms 6*b* of the lateral retention wings 6 whose rear edges 6*d* are in contact, at points B, with the rear surfaces of openings 15. As a result, piston 12, biased frontwardly by spring 13, exerts on the front transverse arms 6*b* on points B, of the lateral retention wings 6 longitudinal forces F which are directed towards the front in a manner so as to pivot the rear arms 6*a* of the wings towards one another, in the direction of the plane of symmetry P.

In this non-limiting embodiment the front abutment 1 comprises, to maintain the front of boot 2 and contain the longitudinal pressure exerted by said boot, two front support elements 16, which are symmetrical with respect to the plane of symmetry P and against which rest the front of the boot sole 2. Each front support element 16 has, seen in a plane, substantially the shape of a center of a circle or a "marine anchor" and it comprises a rear rolling surface 17, of a cylindrical shape having vertical generatrixes. This rolling surface 17 constitutes the rear surface of an element 18 having the shape of an annular segment which is affixed to a substantially radial arm 19 journalled, at its front end, around the general axis 8 of the lateral retention wing 6 on body 4.

Figure 2:
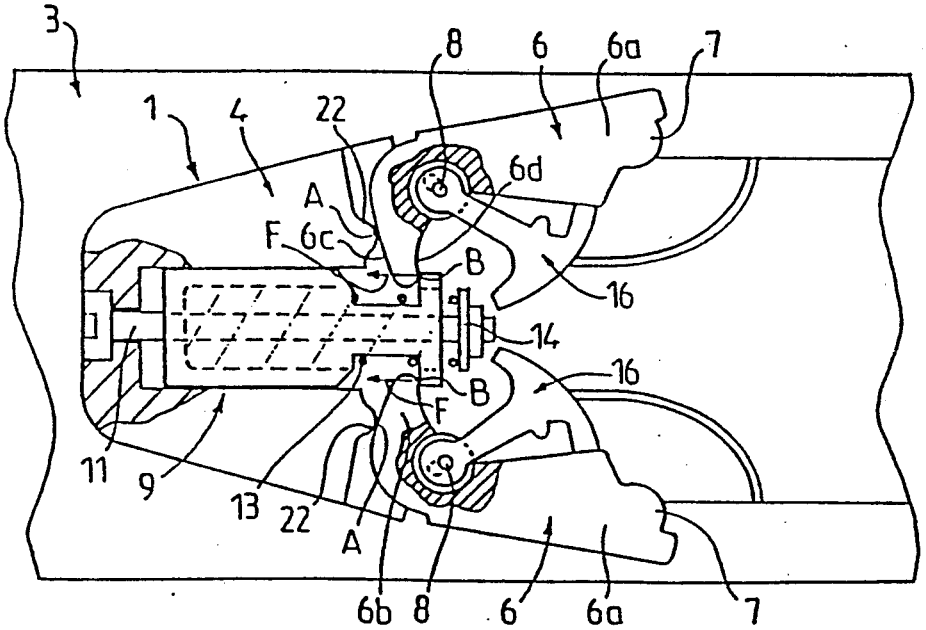
FIG. 2 is a schematic horizontal cross-sectional view of the front abutment of FIG. 1 in the rest position.
Figure 6:
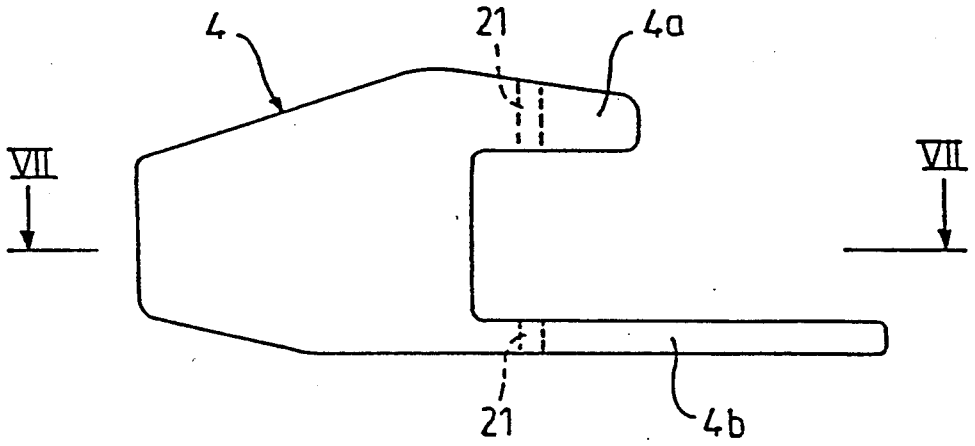
FIG. 6 is an elevational view of the body of the front abutment according to the invention.
Figure 7:
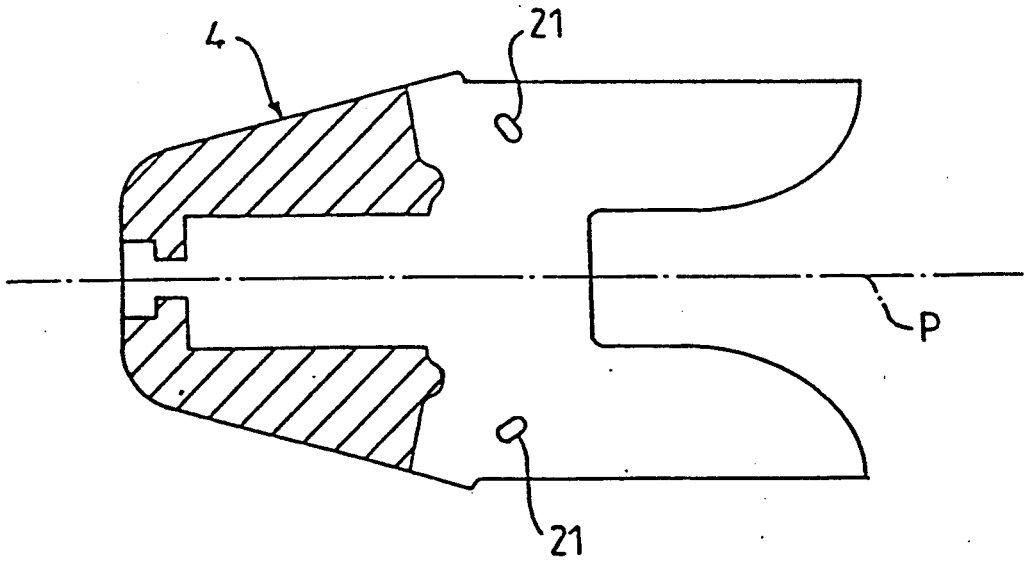
FIG. 7 is a horizontal cross-sectional view along line VII—VII of FIG. 6.

According to the invention the journal axes 8 of wings 6 which are engaged in the adjusted vertical holes drilled in wing 6 are not affixed but can somehow be displaced towards the front and exterior from the position which they occupy during rest, i.e., when the front of boot 2 is not engaged in the front abutment as is shown in FIG. 2. To this end, each journal axis 8 is maintained on body 4 as a result of engagement of its upper and lower end portions in the two oblong holes 21 of same length, parallel to one another, inclined towards the front and exterior, and provided respectively in the upper and lower portions 4*a* and 4*b* respectively, of body 4, as can better be seen in FIG. 6. These inclined oblong holes are likewise symmetrical two-by-two with respect to the vertical and longitudinal plane of symmetry P of the front abutment. Furthermore the short front arm 6*b* of each lateral retention wing 6 is in contact, at the rest position (FIG. 2), through its front edge 6*c*, with a vertical support line A, constituting a temporary pivot axis, a line along which the short front arm 6*b* is in contact with a cylindrical projection 22, having vertical generatrixes, provided in the body 4. Each projection 22, having a convexity turn towards the rear, is positioned on body 4 in a transverse plane corresponding substantially to the front portion of opening 15 provided in the lateral surface of tubular piston 12. In projection in a vertical and transverse plane each projection 22 and the fixed support line A are positioned between the journal axis 8 of wing 6 and the point B of the rear edge 6*d* of the front arm 6*b* which is in contact with the rear surface of opening 15, this point B being consequently the application point of the force F exerted towards the front by the tubular piston 12 of the energy generating mechanism 9.

Each of the oblong holes 21 has a width equal to the diameter of each journal axis 8 and extends preferably along the arc of a circle centered on the fixed support line A or it extends, in its greater dimension along a direction substantially tangent to the arc of a circle centered on the fixed support line A.

The movement of lateral retention wings 6 during the mounting of the boot will now be described with more particular reference to FIGS. 3–5.

Figure 3:
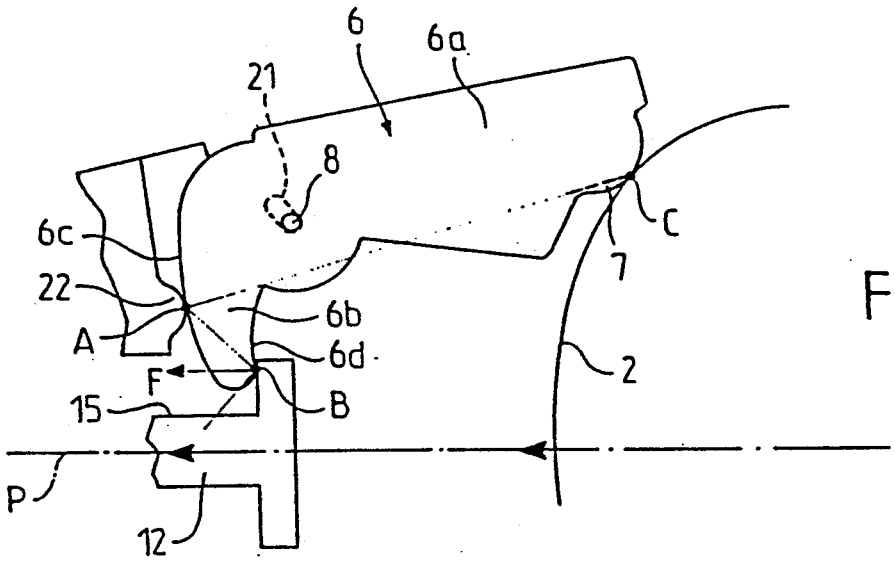
FIGS. 3, 4 and 5 are schematic illustrations illustrating the movement of a lateral retentional wing in the course of engagement of the front of the boot in the front abutment, during mounting of the boot.
Figure 4:
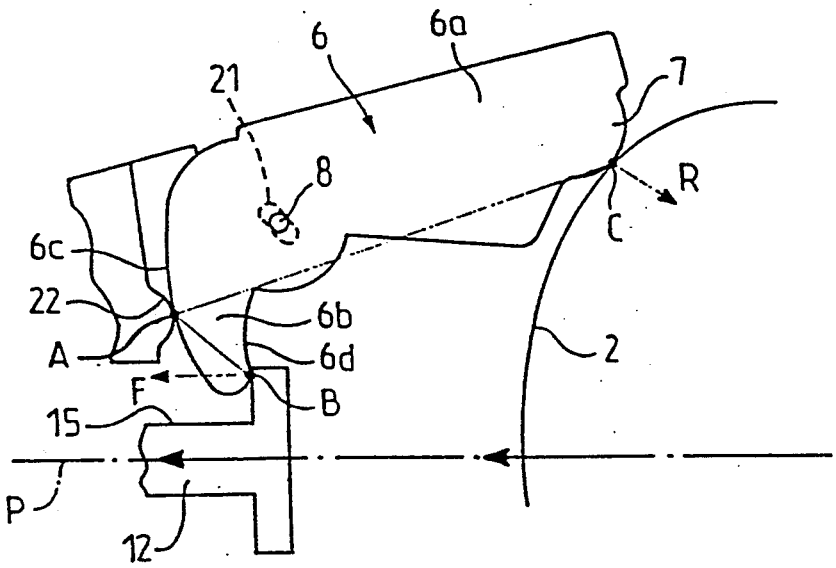

Before mounting of the boot the lateral retention wing 6 occupies the rest position which is shown in FIGS. 2 and 3. In this position the tubular piston 12 biased towards the front by spring 13 of energy generating mechanism 9 exerts on the rear edge 6*d* of front arm 6*b* of wing 6 the force F directed towards the front and which is applied at point B. Furthermore wing 6 is maintained, through the front edge 6*c* of its front arm 6*b* in contact with projection 22 along the length of fixed support line A. The support line A thus constitutes a temporary pivot axis for the lateral retention wing 6 which is thus biased in the clockwise direction under the force of the tubular piston 12. As a result, axis 8 of wing 6 is pushed towards the internal ends of the oblong holes 21, i.e., it is positioned on the side of the plane of symmetry P. FIG. 3 shows the wing 6 just at the moment when the edge of the sole of boot 2, engaged forwards in the front abutment, comes into contact, at a point C, with projection provided on the internal surface of the rear arm 6*a* of the lateral retention wing 6.

When the sole of the boot 2 advances further from the contact position shown in FIG. 3, the edge of the sole which is in contact with the rear arm 6*a* of wing 6 at point C sufficiently pushes this wing towards the exterior such that the entire wing 6 then pivots in the counterclockwise direction around the fixed support line A which thus constitutes a temporary pivot axis. This pivoting occurs against tubular piston 12 which is slightly pushed towards the rear by the front arm 6*b* of wing 6. However, the reaction force R asserted on the edge of the sole at point C by the rear arm 6*a* of wing 6 is relatively small by virtue of the ratio between the lever arms AC on one hand and AB on the other hand. It is seen in effect in FIGS. 3 and 4 that the lever arm AC is much greater than the lever arm AB and as a result, the reaction force R, exerted by the rear arm 6*a* of the wing on the edge of the sole is much weaker than the force F produced by the tubular piston 12. In the course of this phase of insertion of the boot and opening movement of wing 6, journal axis 8 of wing 6 is displaced in its oblong hole 21 towards the front and exterior. FIG. 4 illustrates axis 8 in an intermediate position between the two ends of the oblong holes 21.

Figure 5:
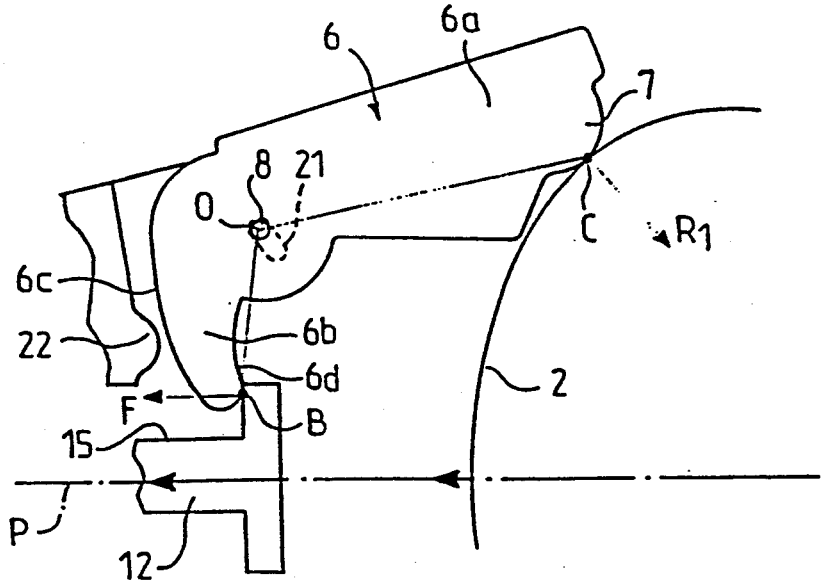

The boot mounting phase with reduced reaction force R occurs until the journal axis 8 is applied against the external ends of oblong holes 21, (i.e.) the end positioned on the side of the ski, as is shown in FIG. 5. This figure shows boot 2 totally engaged in the front abutment 1, in the mounted position, during the skiing. In this position, it is the journal axis 8 which constitutes effectively the new pivot axis for wing 6 which is positioned in the work position. If the boot then biases wing 6 towards the exterior, i.e., in the counterclockwise direction, its front transverse arm 6*b* pivots towards the rear and spaces itself from projection 22 where the fixed support line A is located. Consequently, as can be seen in FIG. 5, the force F exerted frontwardly by tubular piston 12 translates into a reaction force R1 exerted by the rear arm 6*a* of wing 6 on the edge of the sole of the boot which is greater than the reaction force R which was discussed previously. This is a result of the fact that the ratio of the lever arms has been modified because the lever arm OC, between, the center of the journal axis 8 and the contact point C, is less than the distance AC and that, on the other hand, the lever OB is greater than the distance AB.

It can thus be seen, from the preceding description, that in the course of the first phase of mounting, the boot need only overcome a relatively small resistance, which allows for the opening of the lateral retention wings 6 so as to adapt them to the width of the boot and then the front of the boot is maintained firmly in the safety position by the lateral retention wings 6 which exert on the boot much more elevated retention forces.

Figure 8:
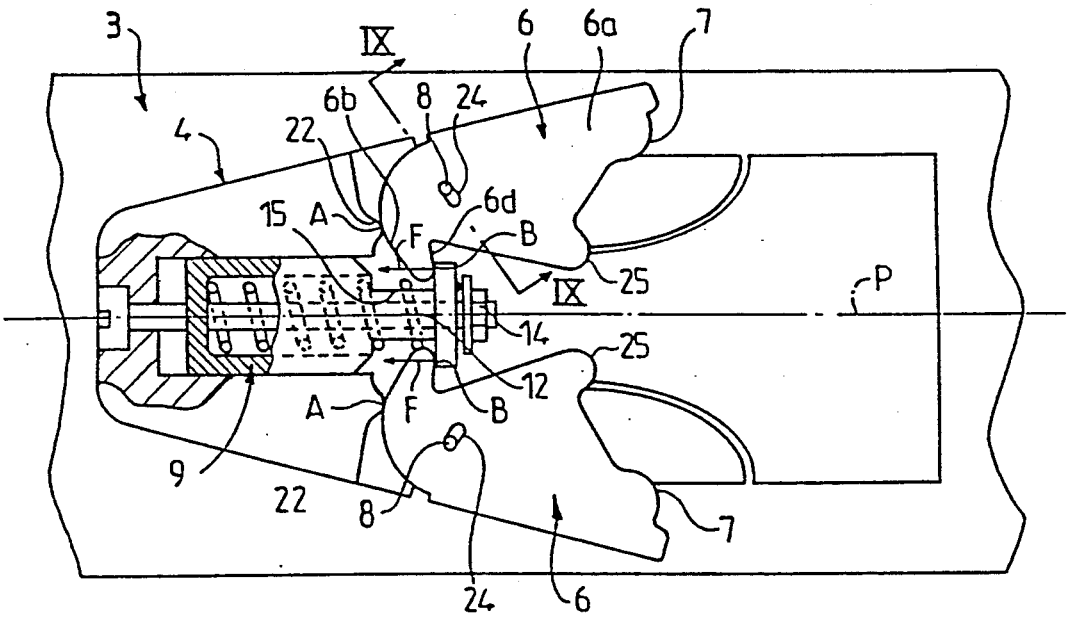
FIG. 8 is a schematic horizontal cross-sectional view of an alternative embodiment of the front abutment according to the invention.
Figure 9:
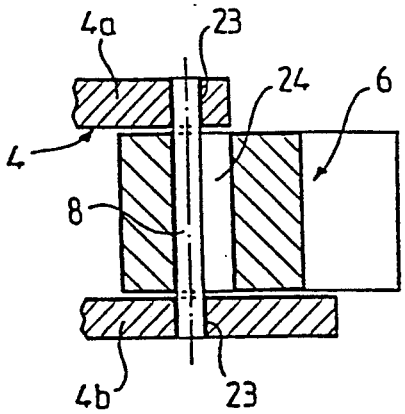
FIG. 9 is a vertical cross-sectional view along lines IX—IX of FIG. 8.

In the embodiment shown in FIGS. 8 and 9, axis 8 of each lateral retention wing 6 is mounted in an aligned manner, at its upper and lower ends, in coaxial holes 23, which are vertically aligned, and which are bored at the upper and lower portions 4*a* and 4*b* of body 4. In this case axis 8 extends across a vertical oblong hole 24 which is bored on both sides and through the lateral retention wing 6. Seen in a plane this oblong hole 24 extends along the arc of a circle centered on the fixed support line A or along a tangent to this arc. Preferably the lateral retention wing 6 is of one piece and it comprises, furthermore, a lateral projection 7, a projection 25 adjacent to the vertical and longitudinal plane of symmetry P and serving as a frontal support for the front of the sole of the boot.

In the rest position, as is shown in FIGS. 8 and 9, the energy generator mechanism 9 maintains the lateral retention wings 6 closed, i.e., tightened towards one another, and each journal axis 8 is then in contact with the external end of the oblong hole 24, i.e. the end positioned on the side of the side of the ski. When the boot is engaged in the front abutment, it forces the lateral retention wings 6 to be spaced towards the exterior and at first these wings pivot around the fixed support lines A. In the course of this pivoting each oblong hole 24 is displaced with respect to the journal axis 8 which remains fixed, until this internal end of the oblong hole 24 comes into contact with the fixed journal axis 8. From that moment the lateral retention wings pivot around the fixed journal axis 8.

Finally, although the invention has been described with reference to particular means, materials and embodiments, it is to be understood that the invention is not limited to particular as disclosed and extends to all equivalence within the scope of the claims.

What is claimed is:

1. A safety binding for a ski for maintaining the front of a boot mounted on the ski, said safety binding comprising a body for containing an energy generating mechanism acting on a retention jaw which includes two independent lateral retention winds, journalled respectively on the body, around independent vertical axes, and which are positioned symmetrically with respect to a vertical and longitudinal plane of symmetry of the binding, said lateral retention wings being elastically biased, by the energy generating mechanism contained in the body, in the direction of the plane of symmetry of the binding, each lateral retention wing, having a general L-shape, comprising, at the rear journal axis, a rear arm extending towards the exterior and towards the rear of the ski for contacting the edge of the sole of the boot, and, in front of its journal axis, a short front arm extending substantially transversely in the direction of the plane of symmetry of the binding, the energy generating mechanism exerting a force on the front of the end portion of the front arm of the wing, each wing having a rest position, in the absence of a boot, and an operating position, after engagement of the boot, in which its rear arm is open towards the exterior of the ski, and wherein each journal axis of a wing with respect to the body is engaged in at least one oblong hole for allowing a relative displacement over a short distance, of the wing with respect to the body, said journal axis being in contact, under the action of said energy generating mechanism, against a first end of the oblong hole in the rest position of the wing and said wing being supported, through a front edge against a fixed support line of the body in a projection in a vertical and transverse plane, between the journal axis of the wing and the end portion of the front arm which is in contact with the energy generating mechanism, and the wing pivoting around said support line during at least a portion of its movement in passing from the rest position to the operating position, until the journal axis of the wing with respect to the body comes into contact against the second end of the oblong hole in which it is engaged.

2. The safety binding for a ski as defined by claim 1 wherein the fixed support line is positioned on a projection of the body, said projection having a convexity turned towards the rear of the ski.

3. The safety for a ski as defined in claim 1 wherein the oblong holes extend substantially along the arcs of a circle centered on the fixed support line.

4. The safety binding for a ski as defined by claim 1 wherein the oblong holes extend along a direction tangent to the arcs of a circle which are respectively centered on respective fixed support lines.

5. The safety binding for a ski as defined by claim 1 wherein the oblong holes have a width substantially equal to the diameter of the journal axes.

6. The safety binding for a ski as defined by claim 1 wherein the oblong holes are formed in the upper and lower portions of the body, the journal axis being mounted in a hole in the lateral retention wing and the upper and lower end portions of said journal axis being engaged in the oblong holes.

7. The safety binding for a ski as defined by claim 1 wherein the oblong hole is bored on both sides of each lateral retention wing, said journal axis extending through said oblong hole and being mounted, at its upper and lower ends, in holes, said holes being vertically aligned, and formed in upper and lower portions of the body.

8. The safety ski binding for a ski as defined by claim 1, wherein said at least one oblong hole is formed in said body.

9. The safety ski binding for a ski as defined by claim 1, wherein said at least one oblong hole is formed in a respective retention wing.

* * * * *

UNITED STATES PATENT AND TRADEMARK OFFICE

CERTIFICATE OF CORRECTION

PATENT NO. : 5,102,157

DATED : April 7, 1992

INVENTOR(S) : G. RENAUD GOUD et al.

It is certified that error appears in the above-identified patent and that said Letters Patent is hereby corrected as shown below:

Title page, item [75] Inventors:
change "Gilles R. GOUD" to ---Gilles RENAUD GOUD---.

Signed and Sealed this

Fourteenth Day of September, 1993

Bruce Lehman

*Attest:*

BRUCE LEHMAN

*Attesting Officer*

*Commissioner of Patents and Trademarks*